US007207696B1

(12) United States Patent
Lin

(10) Patent No.: US 7,207,696 B1
(45) Date of Patent: Apr. 24, 2007

(54) LED LIGHTING WITH ADJUSTABLE LIGHT PROJECTING DIRECTION

(76) Inventor: Chu-Hsien Lin, No. 48, Alley 15, Lane 229, Chung-Hua Rd., Sec. 6, Hsin-Chu City (TW)

( * ) Notice: Subject to any disclaimer, the term of this patent is extended or adjusted under 35 U.S.C. 154(b) by 0 days.

(21) Appl. No.: 11/333,335

(22) Filed: Jan. 18, 2006

(51) Int. Cl.
*F21V 21/30* (2006.01)

(52) U.S. Cl. ..... 362/250; 362/232; 362/233; 362/238; 362/239; 362/285

(58) Field of Classification Search ..... 362/219, 362/232–233, 238–239, 269–272, 285–287, 362/371–372, 250, 549, 648–649, 386, 418, 362/426–430, 800, 545, 555; 439/115, 225, 439/240, 228
See application file for complete search history.

(56) References Cited

U.S. PATENT DOCUMENTS 4,943,900 A * 7/1990 Gartner ..... 362/227

* cited by examiner

*Primary Examiner*—Renee Luebke
*Assistant Examiner*—Robert J. May
(74) *Attorney, Agent, or Firm*—Troxell Law Office, PLLC

(57) ABSTRACT

An LED lighting includes a lamp holder defining at least one receiving space having two partitions provided at two ends thereof, and at least one lamp bank including at least one LED each. The lamp bank is received in the receiving space of the lamp holder by extending two conductive metal cylindrical members located in the two partitions into through holes on two metal end plates at two ends of the lamp bank. The metal cylindrical members are electrically connected to positive and negative electrodes of a power supply, and the two metal end plates serve as two power input ends of the lamp bank. The lamp bank is rotatable about the two metal cylindrical members to adjust the LED light projecting direction while the two metal end plates are in contact with and accordingly electrically connected to the metal cylindrical members to keep the LED in an illuminating state.

12 Claims, 3 Drawing Sheets

LED LIGHTING WITH ADJUSTABLE LIGHT PROJECTING DIRECTION

FIELD OF THE INVENTION

The present invention relates to an LED lighting with adjustable light projecting direction, in which a lamp bank including at least one LED (light emitting diode) is supported on two pivoting points at two ends of a receiving space in a lamp holder to obtain power supply via the pivoting points and be rotatable about the pivoting points to adjust the light projecting direction of the LED.

BACKGROUND OF THE INVENTION

Incandescent bulbs, quartz bulbs, fluorescent bulbs, PL lamps, and mercury lamps are most frequently used on daily lighting fixtures as light sources. Since these bulbs or lamps are mainly designed for illuminating a big space, they are usually mounted on a ceiling. However, there are also many relatively small storing and/or displaying spaces, such as book cases, book shelves, shoe cabinets, wardrobes, showcases and show windows in bakeries and jeweler's shops, etc., that require sufficient light sources to highlight the displayed products but do not have enough space to mount the conventional light sources. In other words, the conventional light sources are not suitable or practical for use in the narrower spaces due to their big volume.

The fluorescent bulbs, PL lamps, and quartz halogen bulbs are frequently employed in different places depending on the users' actual need. However, they usually have a big volume and undesirable configurations, and/or produce a large amount of heat during operation, and therefore could not be satisfactorily used in narrower or smaller spaces as light sources.

To overcome the above-mentioned problems, most users would try to increase the number of light sources in the open or big space in an attempt to illuminate every narrow or small corner in the space. This inevitably increases the user's burden and causes unnecessary waste of valuable energy.

On the other hand, the LED has the advantages of low power consumption, high illuminating efficiency, and small volume, and is therefore very suitable for use in a narrow and small space as a light source. However, with the currently available LED lighting mounting techniques, the lamp holder of the LED lighting is manually welded to a fixed place and could not be moved once it is so mounted.

This forms a big restriction on the application of LED lighting. In view that LED has the brightness, usable life, reliability, and price satisfactorily meeting the commercial lighting requirements, and has the advantages of low power consumption and small volume, it is therefore tried by the inventor to develop an economical, simple, active, and energy-saving LED lighting to overcome the problems existed in the conventional light sources.

SUMMARY OF THE INVENTION

A primary object of the present invention is to provide an LED lighting with adjustable light projecting direction, of which the LED lamp banks could be differently rotated relative to a lamp holder, so that light emitted from the LED lamp banks could be projected to different corners in a space as desired.

Another object of the present invention is to provide an LED lighting with adjustable light projecting direction, which is particularly suitable for illuminating a relatively narrow and small space, and the LED lamp banks thereof could be adjusted toward a desired light projecting direction to focus light on a desired target.

A further object of the present invention is to provide an LED lighting with adjustable light projecting direction, of which the LED lamp banks are easy to mount and dismount to and from the fixed lamp holder, making the LED lighting practical for use.

To achieve the above and other objects, the LED lighting with adjustable light projecting direction according to the present invention includes a lamp holder defining at least one receiving space having two partitions provided at two ends thereof, and at least one lamp bank including at least one LED each. The lamp bank is received in the receiving space of the lamp holder by extending two conductive metal cylindrical members located in the two partitions into through holes on two metal end plates at two ends of the lamp bank, such that the lamp bank is rotatable about the two metal cylindrical members to adjust the LED light projecting direction thereof.

In the LED lighting with adjustable light projecting direction according to the present invention, the metal cylindrical members located at two ends of the lamp bank are electrically connected to positive and negative electrodes of a power supply, and the two metal end plates serve as two power input ends of the lamp bank. Therefore, when the lamp bank is rotated about the two metal cylindrical members, the two metal end plates keep in contact with and accordingly electrically connected to the metal cylindrical members to keep the LED's of the lamp bank in an illuminating state.

In the LED lighting with adjustable light projecting direction according to the present invention, a metal spring is compressed in each of the metal cylindrical members, allowing two ends of the metal cylindrical member to be elastically pushed inward all the time to facilitate easy and convenient mounting and dismounting of the lamp bank to and from the metal cylindrical members, and keep the metal end plates of the lamp bank in good contact with the metal cylindrical members.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
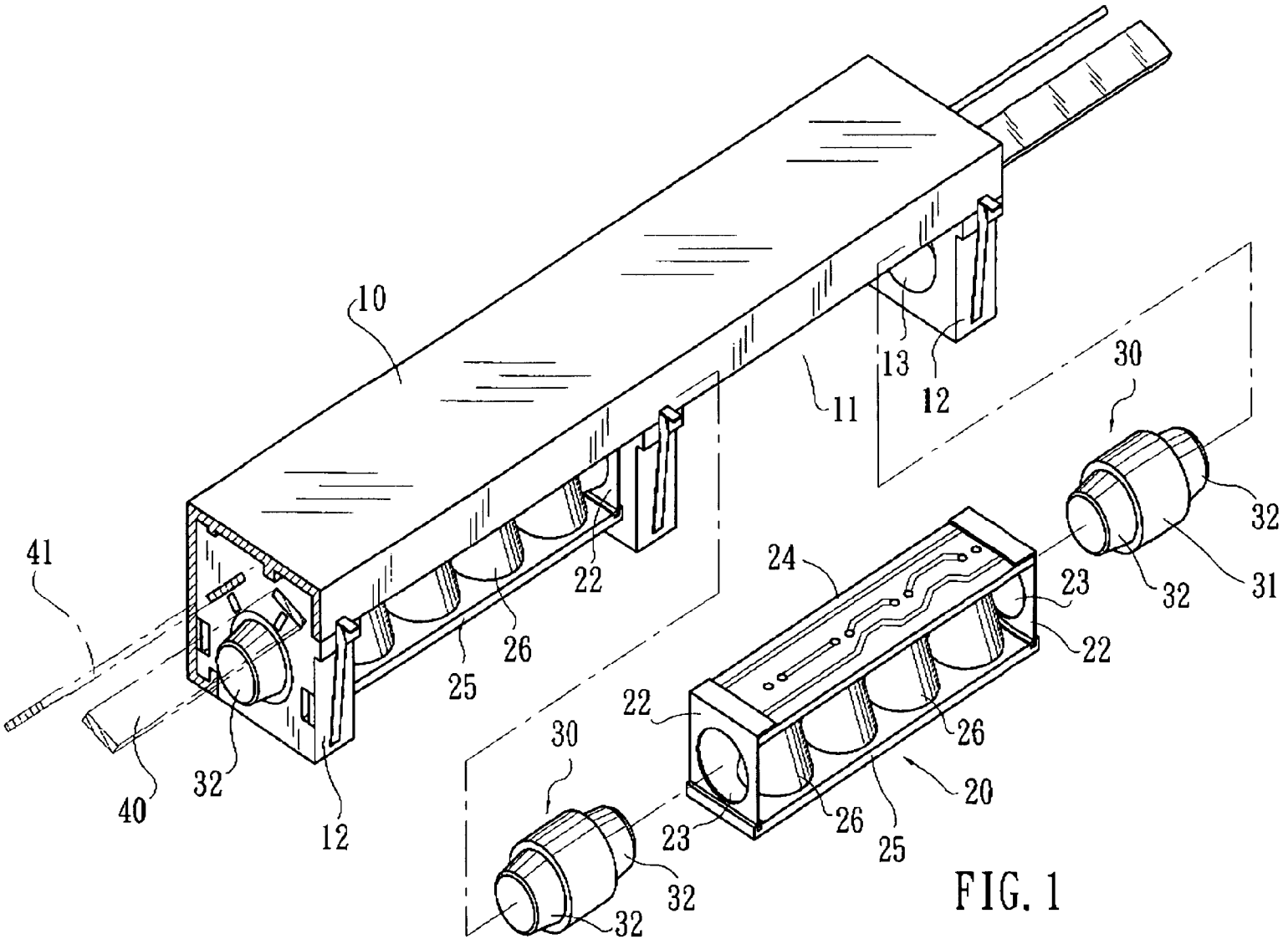
FIG. 1 is an exploded perspective view of an LED lighting with adjustable light projecting direction according to a preferred embodiment of the present invention.
Figure 2:
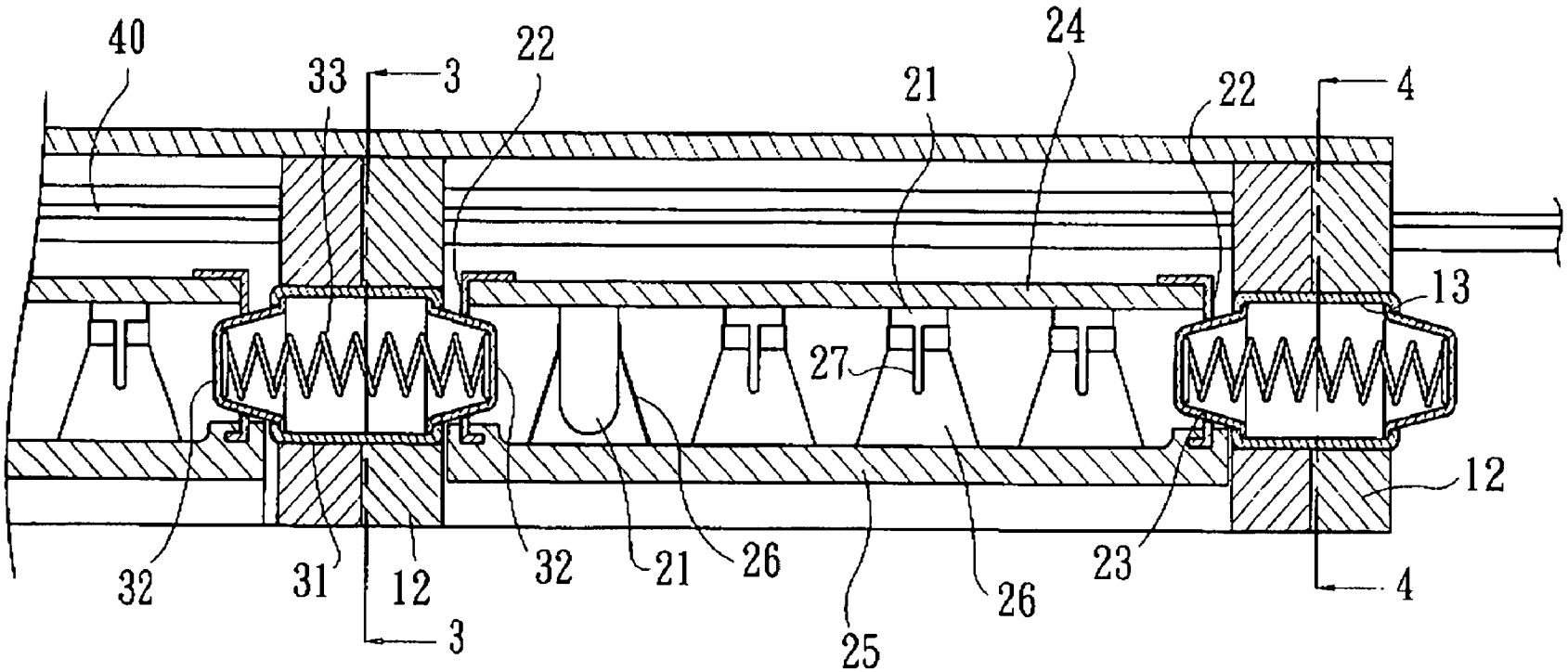
FIG. 2 is an assembled sectional view of the LED lighting shown in FIG. 1.

Please refer to FIGS. 1 and 2 in which an LED lighting with adjustable light projecting direction according to a preferred embodiment of the present invention is shown. As shown, the LED lighting of FIG. 1 includes a lamp holder 10 providing at least one receiving space 11, and at least one lamp bank 20 detachably mounted in the receiving space 11 of the lamp holder 10. Every receiving space 11 on the lamp holder 10 is provided at two ends with a partition 12 each, and the partition 12 is provided at a predetermined position with a first through hole 13. The lamp bank 20 includes at least one LED 21 (see FIG. 2), and has a metal end plate 22 fixedly mounted to each lateral end thereof. The metal end plate 22 is provided at a central area with a second through hole 23.

A metal cylindrical member 30 is received in the first through holes 13 of two adjoining partitions 12 with two ends of the metal cylindrical member 30 axially protruded from two opposite sides of the two adjoining partitions 12. Each of the protruded ends of the metal cylindrical member 30 is adapted to extend through the second through hole 23 on the metal end plate 22 at each lateral end of the lamp bank 20. Therefore, the lamp bank 20 is held in the receiving space 11 between two spaced partitions 12 by the cylindrical metal members 30 and could be pivotally turned about the axially protruded ends of the metal cylindrical members 30 to adjust the light projecting direction of the LED 21 mounted on the lamp bank 20.

Figure 3:
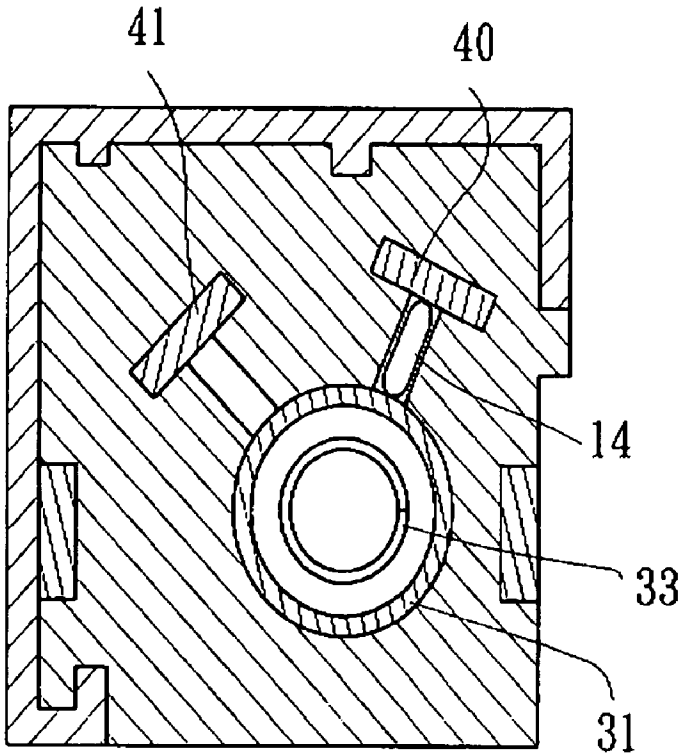
FIG. 3 is a sectional view taken along line 3—3 of FIG. 2.

Please refer to FIGS. 1, 2, and 3 at the same time. The metal cylindrical member 30 includes a tubular body 31 having two open ends, two end caps 32 axially movably mounted to the two open ends of the tubular body 31, and a metal spring 33 mounted in the tubular body 31 between the two end caps 32 in a compressed state. Each of the open ends of the tubular body 31 has a radially inward bent rim, and each of the end caps 32 has an inclined wall tapered toward a closed end thereof and a radially outward bent rim at an open end thereof. When the end cap 32 is mounted to the tubular body 31, the radially inward bent rim of the open end of the tubular body 31 is pressed against an outer surface of the radially outward bent rim of the end cap 32, preventing the end cap 32 from moving out of the tubular body 31. The end cap 32 has an outer diameter measured at the rim close to an inner diameter of the tubular body 31, so that the end cap 32 is always in contact with an inner wall surface of the tubular body 31 when it is axially moved relative to the tubular body 31. The metal spring 33 is compressed in the tubular body 31 with two ends contacting with the two end caps 32, so that the tubular body 31, the end caps 32, and the metal spring 33 are electrically connected to one another. With the metal spring 33, the two end caps 32 could be elastically pushed inward at the open ends of the tubular body 31.

To mount the lamp bank 20 in the receiving space 11 of the lamp holder 10, first press two ends of the lamp bank 20 against the inclined walls of the end caps 32 of the two metal cylindrical members 30 at two lateral ends of the receiving space 11, so that the end caps 32 are forced into the tubular bodies 31, allowing the lamp bank 20 to move to a desired mounting position. When the second through holes 23 on the two metal end plates 22 of the lamp bank 20 are aligned with the end caps 32, the end caps 32 are immediately elastically pushed by the metal springs 33 into the second through holes 23 to hold the lamp bank 20 in place. When it is desired to dismount the lamp bank 20 from the receiving space 11, just slightly push the end caps 32 into the tubular bodies 31 using a thin bar, such as a pen or a small screwdriver, and the lamp bank 20 can be released from the metal cylindrical members 30 and removed from the receiving space 11. With above arrangements, the lamp bank 20 could be conveniently mounted and dismounted to and from the receiving space 11 of the lamp holder 10, allowing a user to easily replace the lamp bank 20 with a new one when necessary.

Figure 4:
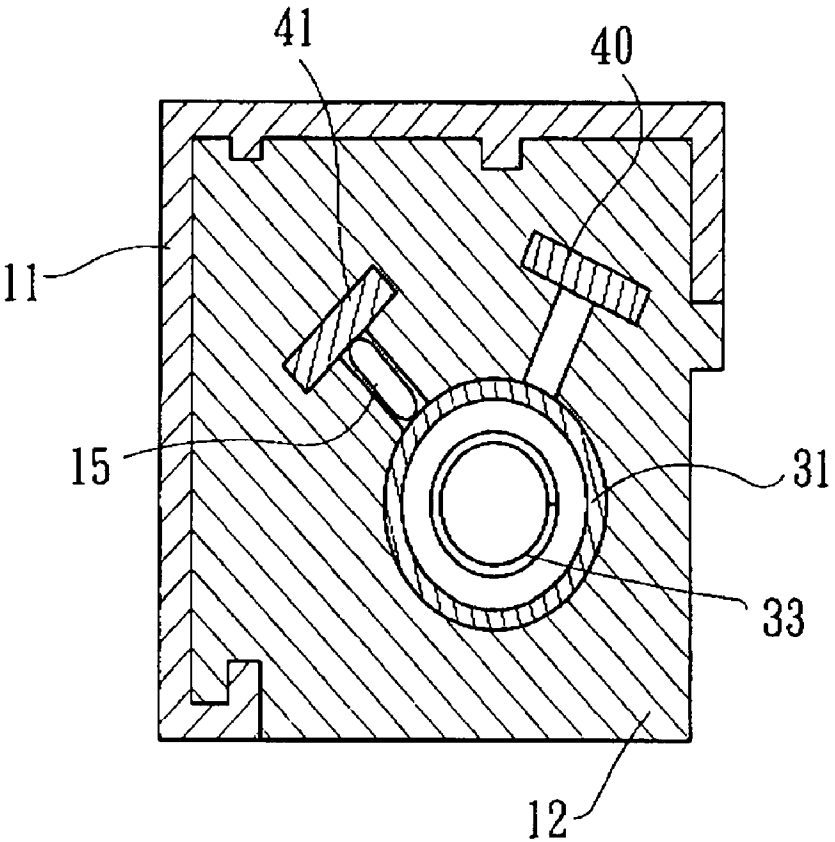
FIG. 4 is a sectional view taken along line 4—4 of FIG. 2.

Please refer to FIGS. 1, 3, and 4 at the same time. In the present invention, the lamp holder 10 is slidably mounted on two conductive copper rails 40, 41 that are extended through two openings provided at predetermined positions on every partition 12. The two copper rails 40, 41 are respectively connected to positive and negative electrodes of a power source, which preferably has an input voltage of 12v. Every partition 12 on the lamp holder 10 has an elastic terminal 14 or 15 embedded therein to electrically connect one of the copper rails 40 or 41 to the metal cylindrical member 30 mounted on that partition 12. It is noted the elastic terminals 14, 15 embedded in two adjoining partitions 12 are in contact with different copper rails 40, 41; and the two metal cylindrical members 30 for holding two ends of the lamp bank 20 form two power inputs.

Please refer to FIGS. 1 and 2 again. In addition to the at least one LED 21 and two metal end plates 22, the lamp bank 20 also includes a circuit board 24 and a frosted glass 25 forming a top and a bottom, respectively, of the lamp bank 20. The LED's 21 are fixedly mounted to a lower side of the circuit board 24, and are separately surrounded by a downward opened metal shade 26 each to block out halos and glares produced by the LED's 21. The frosted glass 25 is fixedly located below the metal shades 26 to confine the LED's 21 and the metal shades 26 in a space defined between the circuit board 24 and the frosted glass 25, and functions to disperse and thereby soften the light emitted from the LED's 21. The two metal end plates 22 are fixed to two ends of the lamp bank 20. The circuit board 24 includes inputs of positive and negative power and a control circuit. Since the control circuit is known in the art, it is not discussed herein. The metal shade 26 is provided at an upper part that is fitly put around an outer surface of the LED 21 with a cut 27 to give the upper part of the metal shade 26 a certain expandability to facilitate convenient fitting of the metal shade 26 around the LED 21. The cut 27 on the metal shade 26 also enables good dissipation of heat produced by the LED 21.

When the lamp bank 20 is mounted on the lamp holder 10, power is supplied via the copper rails 40, 41, the elastic terminals 14, 15, the metal cylindrical members 30, and the metal end plates 22 to the circuit controlling the lighting of the LED's 21. When the lamp bank 20 is rotated about the metal cylindrical members 30, the two metal end plates 22 of the lamp bank 20 are always in contact with the end caps 32 of the metal cylindrical members 30, so that the lamp bank 20 being adjusted is still electrically connected to the power supply for the LED's 21 to continuously emit light. The metal spring 33 compressed in the metal cylindrical member 30 constantly keeps the two end caps 32 in an elastically retractable state, allowing the metal end plates 22 to well contact with the end caps 32 of the metal cylindrical member 30 all the time.

More than one lamp bank 20 can be mounted to the lamp holder 10, and every lamp bank 20 can be independently rotated about the metal cylindrical members 30 to adjust the light projecting direction thereof. The lamp holder 10 is put on and slidable along the copper rails 40, 41. When more than one lamp holder 10 is sequentially slidably mounted on the copper rails 40, 41, all the lamp holders 10 could be axially shifted to change their positions on the rails 40, 41, while the lamp banks 20 mounted on the lamp holders 10 could still be independently rotated to change the light projecting direction thereof, allowing more flexibility and changes in the use of the LED lighting.

In brief, the LED lighting of the present invention is easy to mount and dismount, and has independently turnable lamp banks to adjust the light projecting direction thereof, and is therefore an economical and practical design. Moreover, since the present invention is slidably mounted on conductive copper rails, it is more convenient for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An LED lighting with adjustable light projecting direction, comprising:

a lamp holder providing at least one receiving space, every said receiving space being provided at two ends with a metal cylindrical member each to separately electrically connect to a positive and a negative electrode of a power supply; and a lamp bank received in said receiving space on said lamp holder; said lamp bank including at least one LED, and having two metal end plates fixedly mounted to two ends thereof to form two power input ends of said lamp bank; and each of said two metal end plates being provided at a central area with a through hole;

wherein said lamp bank is received in said receiving space by extending said metal cylindrical members at two ends of said receiving space into said through holes on said two metal end plates of said lamp bank, such that said lamp bank is rotatable about said two metal cylindrical members to adjust a projecting direction of light emitted from said at least one LED included in said light bank.

2. The LED lighting with adjustable light projecting direction as claimed in claim 1, wherein said metal cylindrical member includes a tubular body, two end caps, and a metal spring; said two end caps being movably mounted to two open ends of said tubular body, and two open ends of said tubular body having a radially inward bent rim each pressed against an outer surface of a radially outward bent rim of each said end cap to prevent said end caps from moving out of said tubular body; and said metal spring being mounted in said tubular body between said two end caps in a compressed state, enabling said two end caps to be elastically pushed inward relative to said tubular body.

3. The LED lighting with adjustable light projecting direction as claimed in claim 2, wherein said end cap has an outer diameter measured at said radially outward bent rim close to an inner diameter of said tubular body; such that said radially outward bent rim of said end cap is always in contact with an inner wall surface of said tubular body.

4. The LED lighting with adjustable light projecting direction as claimed in claim 1, wherein said lamp bank further includes a circuit board and a frosted glass that form a top and a bottom, respectively, of said lamp bank; said at least one LED being fixedly mounted to a lower side of said circuit board, and surrounded by a downward opened metal shade each; and said frosted glass being fixedly located below said metal shade.

5. The LED lighting with adjustable light projecting direction as claimed in claim 1, wherein every said receiving space of said lamp holder is provided at two ends with a partition each, said partitions being provided at a predetermined position with a through hole each, in which said metal cylindrical members are located; and each of said partitions having an elastic terminal embedded therein with an end in contact with said metal cylindrical member.

6. The LED lighting with adjustable light projecting direction as claimed in claim 5, wherein said elastic terminal embedded in said partition has another end in contact with a copper rail.

7. The LED lighting with adjustable light projecting direction as claimed in claim 1, wherein said lamp holder is put on and slidable along two conductive copper rails.

8. An LED lighting with adjustable light projecting direction, comprising:

a lamp holder providing at least one receiving space, said at least one receiving space being provided at two ends with a partition which said partition being configured to have a metal cylindrical member extending therethrough to protrude two ends of said metal cylindrical member from two opposite sides of said partition;

a lamp bank received in said receiving space on said lamp holder; said lamp bank including at least one LED, and having two metal end plates fixedly mounted to two ends thereof to form two power input ends of said lamp bank; and each of said two metal end plates being provided at a central area with a through hole; and two conductive copper rails forming a positive and a negative electrode of a power supply to said LED lighting;

wherein said lamp holder is put on and slidable along said two conductive copper rails; and every said partition of said lamp holder has an elastic terminal embedded therein, such that two ends of said elastic terminal are respectively in contact with one of said two copper rails and said metal cylindrical member located in said partition; and said lamp bank is received in said receiving space by extending said metal cylindrical members at two ends of said receiving space into said through holes on said two metal end plates of said lamp bank, such that said lamp bank is rotatable about said two metal cylindrical members to adjust a projecting direction of light emitted from said at least one LED included in said light bank.

9. The LED lighting with adjustable light projecting direction as claimed in claim 8, wherein said metal cylindrical member includes a tubular body, two end caps, and a metal spring; said two end caps being movably mounted to two open ends of said tubular body, and two open ends of said tubular body having a radially inward bent rim each pressed against an outer surface of a radially outward bent rim of each end cap to prevent said end caps from moving out of said tubular body; and said metal spring being mounted in said tubular body between said two end caps in a compressed state, enabling said two end caps to be elastically pushed inward relative to said tubular body.

10. The LED lighting with adjustable light projecting direction as claimed in claim 9, wherein said end cap has an outer diameter measured at said radially outward bent rim close to an inner diameter of said tubular body, such that said radially outward bent rim of said end cap is always in contact with an inner wall surface of said tubular body.

11. The LED lighting with adjustable light projecting direction as claimed in claim 8, wherein said lamp bank further includes a circuit board and a frosted glass that form a top and a bottom, respectively, of said lamp bank; said at least one LED being fixedly mounted to a lower side of said circuit board, and surrounded by a downward opened metal shade each; and said frosted glass being fixedly located below said metal shade.

12. The LED lighting with adjustable light projecting direction as claimed in claim 8, wherein said elastic terminal embedded in said partition of said lamp holder has an end in contact with one of said two copper rails.

* * * * *